US006311786B1

(12) United States Patent
Giardino et al.

(10) Patent No.: US 6,311,786 B1
(45) Date of Patent: Nov. 6, 2001

(54) PROCESS OF DETERMINING TORQUE OUTPUT AND CONTROLLING POWER IMPACT TOOLS USING IMPULSE

(75) Inventors: David A. Giardino, Rock Hill, SC (US); Stephen M. DeMarco, Charlotte, NC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 0 days.

(21) Appl. No.: 09/204,698

(22) Filed: Dec. 3, 1998

(51) Int. Cl.[7] ..... B25B 23/14

(52) U.S. Cl. ..... 173/1; 173/177; 173/180; 173/181; 173/183; 73/862.23

(58) Field of Search ..... 173/1, 2, 176, 173/177, 180, 181, 182, 183; 81/467, 470; 73/761, 862.23, 862.24

(56) References Cited

U.S. PATENT DOCUMENTS 5,181,575 * 1/1993 Maruyama et al. ..... 173/180
5,285,857 * 2/1994 Shimada ..... 173/181
5,289,886 * 3/1994 Shikata et al. ..... 173/181
5,315,501 * 5/1994 Whitehouse ..... 173/181
5,351,555 10/1994 Garshelis .
5,366,026 11/1994 Maruyama et al. .
5,465,627 11/1995 Garshelis .
5,492,185 * 2/1996 Schoeps et al. ..... 173/181
5,708,216 1/1998 Garshelis .
5,715,894 2/1998 Maruyama et al. .
5,937,370 * 8/1999 Lysaght ..... 173/180

OTHER PUBLICATIONS

Differing Torque Sensing Technologies, pp. 4–17, 1998 Magna–lastic Devices, Inc.

* cited by examiner

*Primary Examiner*—Scott A. Smith
(74) *Attorney, Agent, or Firm*—Schmeiser, Olsen & Watts

(57) ABSTRACT

A process to more accurately determine torque output of power impact tools using impulse. Also disclosed are processes for controlling power impact tools, in particular a mechanical impact wrench, by determining the impulse of the tool impacts and deriving torque values therefrom. A mechanical impact wrench having an electronic control is also disclosed.

14 Claims, 4 Drawing Sheets

PROCESS OF DETERMINING TORQUE OUTPUT AND CONTROLLING POWER IMPACT TOOLS USING IMPULSE

BACKGROUND OF THE INVENTION

1. Technical Field

The present invention relates to processes for determining torque output and controlling power impact tools using impulse. The invention also relates to a mechanical impact wrench having electronic control.

2. Related Art

In the related art, control of power impact tools has been accomplished by directly monitoring the torque of impacts of the tool. For instance, in U.S. Pat. Nos. 5,366,026 and 5,715,894 to Maruyama et al., incorporated herein by reference, controlled impact tightening apparatuses are disclosed in which complex processes involving direct torque measurement are used. Direct torque measurement involves the measurement of the force component of torsional stress, as exhibited by a magnetic field about a tool output shaft, at the point in time of impact. From this force component, related art devices directly determine the torque applied during the impact, i.e., torque T=force F times length of torque arm r. As exemplified by FIG. 10 of U.S. Pat. No. 5,366,026, however, torque measurements fluctuate, even after a large number of impacts are applied. This phenomena is caused by the inconsistent nature of the force component of the impact. In particular, some devices measure torque at a given point in time, such that the torque measured is based on whatever force is being applied at that point in time. In other cases, the force is monitored as it rises, and is measured for peak at a point in time at which a force decrease is detected. In either case outlined above, the force may not be the peak force and, hence, the peak torque derived may not be accurate.

To rectify this problem, related art devices use weighting factors, or peak and/or low pass filtering of torque peak measurement, and/or assume, even though it is not the case, a constant driving force from the motor. For instance, in U.S. Pat. No. 5,366,026, torque measurements are used to calculate a clamping force based on the peak value of a pulsatory torque and an increasing coefficient that represents an increasing rate of a clamping force applied. Unfortunately, torque measurement accuracy remains diminished. Accordingly, there exists a need for better processes of operating power impact tools and, in particular mechanical impact tools (i.e., those with mechanical impact transmission mechanisms), with greater accuracy of torque measurement. There also exists a need for more accurate torque measurement.

Another shortcoming of the related art is the lack of an electronic control in a mechanical impact wrench.

SUMMARY OF THE INVENTION

In a first aspect of the invention a process is provided for determining the torque applied by a power impact tool, comprising the steps of: determining the impulse of a tool impact; and calculating a torque value of the tool from the impulse. This aspect provides a more accurate measurement of torque applied by a power tool by deriving the torque from an impulse determination of each impact during, for example, the tightening process of a threaded fastener joint. Because impulse determinations include a time parameter, fluctuations of force over time, which are not accounted for in direct torque measurements, can be taken into account. As a result, the measured torque values derived from the measured impulse values allow for more precise operation of the tool and more precise action on a workpiece.

In a second aspect of the invention a process is provided for controlling a power tool that applies repetitive torque impacts to a workpiece, comprising the steps of: determining an impulse value from a measured force value of each tool impact; calculating a torque value of the tool from the impulse value; determining whether the torque value meets a torque standard for the workpiece; and stopping operation of the tool when the torque value violates the standard. This aspect provides the overall operational process for operating an impact tool using impulse determinations. As an alternative to this aspect, the number of tool impacts and the time duration of operation may be monitored for further precision.

In a third aspect of the invention a process is provided for controlling a mechanical impact tool, comprising the steps of: determining an impulse value of each tool impact; calculating a torque value of the tool from the impulse; determining whether the torque value meets a torque standard for the workpiece; and stopping operation of the tool when the torque value violates the standard. This aspect provides the same advantages of the second aspect but on a mechanical impact tool.

In a fourth aspect of the invention a mechanical impact wrench is provided comprising: a motor; a mechanical impact transmission mechanism coupled to the motor to repetitively transmit an impact to the output shaft; and an electronic control to control operation of the mechanical impact wrench. This aspect provides the never before furnished electronic control of a mechanical impact wrench so as to provide increased accuracy, longevity, and lower costs over prior art devices.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of the preferred embodiment.

Figure 1:
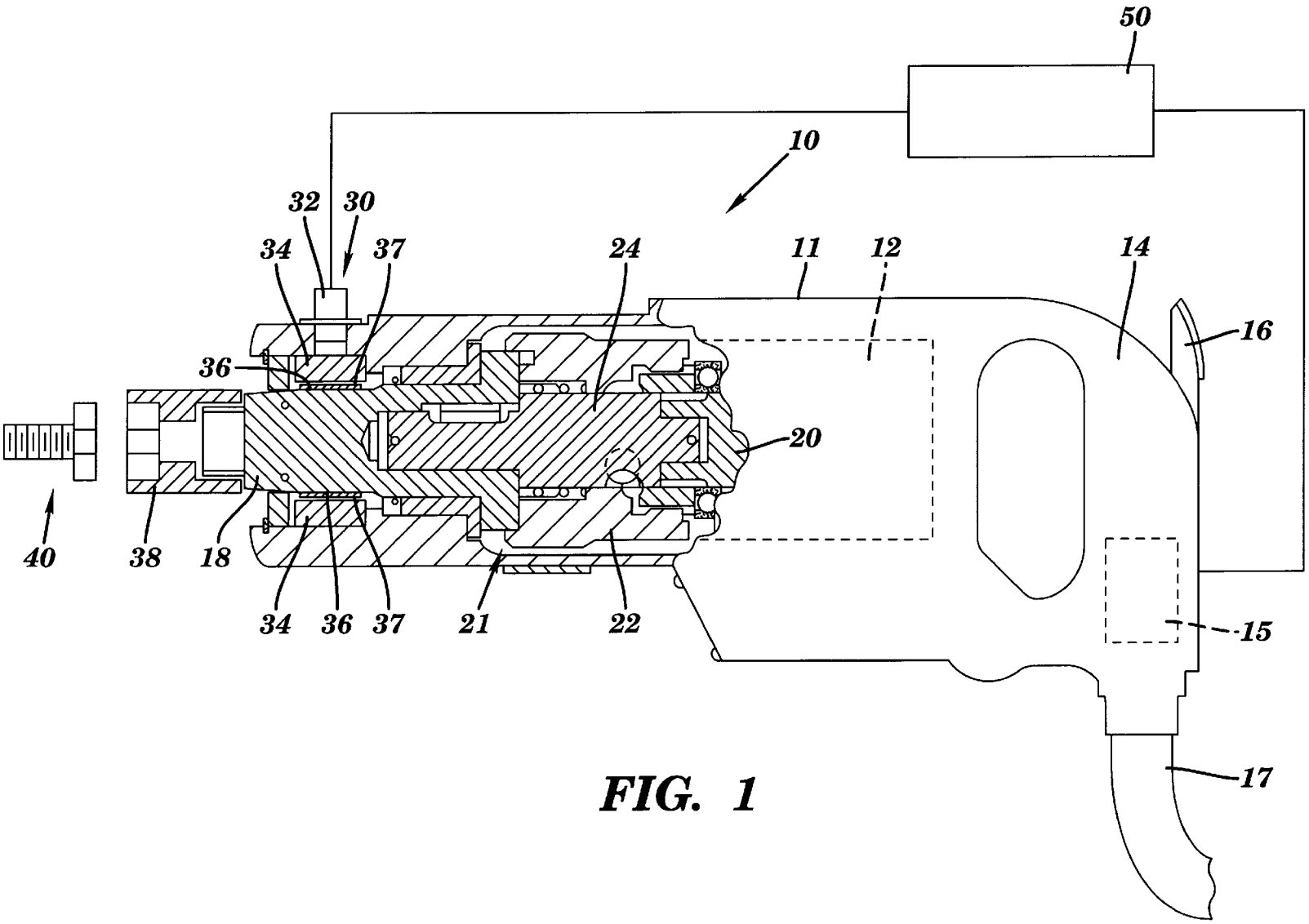
FIG. 1 shows a power tool in accordance with the present invention.

Referring to FIG. 1, a power impact tool 10 in accordance with the present invention is shown. It should be recognized that while power impact tool 10 is exemplified in the form of a mechanical impact wrench, the teachings of the present invention have applicability to a diverse range of power impact tools. Hence, although the teachings of the present invention provide particular advantages to a mechanical impact wrench, the scope of the invention should not be limited to such devices.

The power tool 10 includes a housing 11 for a motor 12 (shown in phantom), e.g., electric, pneumatic, hydraulic, etc. Housing 11 includes a handle 14 with activation trigger 16 therein. Power tool 10 also includes a mechanical impact transmission mechanism 21 having an output shaft or anvil 18, and a hammer 22, possibly coupled to output shaft or anvil 18 by an intermediate anvil 24. Hammer 22 is rotated by motor 12 via motor output 20 to physically and repetitively strike or impact output shaft or anvil 18 and, hence, repetitively transmit an impact through socket 38 to workpiece 40. It should be recognized that impact transmission mechanism 21 may take a variety of other forms that are recognized in the art and not diverge from the scope of this invention. Further, it should be recognized that socket 38 may take the form of any adapter capable of mating with workpiece 40 to output shaft 18, and that the workpiece 40 could also be varied. For instance, the workpiece could be a nut, bolt, etc.

Power tool 10 additionally includes a shutoff 15 located preferably in the handle 14. The shutoff 15, however, could be located in housing 11, or pressurized fluid supply line 17 if one is required. Shutoff 15 is activated by data processing unit or electronic control 50 to stop operation of power tool 10, as will be described below. While electronic control 50 is shown exterior to power tool 10, it may also be provided within power tool 10, if desired. If power tool 10 is a pneumatic tool, shutoff 15 is a shutoff valve. If an electric motor is used, shutoff 15 can be embodied in the form of a control switch or like structure.

Power tool 10, in the form of a mechanical impact wrench, includes a ferromagnetic sensor 30. Sensor 30 is permanently attached as shown, however, it is contemplated that the device can be replaceable for ease of repair. Sensor 30 includes a coupling 32 for connection to a data processing unit 50, a stationary Hall effect or similar magnetic field sensing unit 34, and a ferromagnetic part 36. Preferably, the ferromagnetic part 36 is a magneto-elastic ring 37 coupled to the output shaft 18 of power tool 10. Such magneto-elastic rings 37 are available from sources such as Magna-lastic Devices, Inc., Carthage, Ill. In the preferred embodiment, the magneto-elastic ring 37 surrounds or is around the output shaft 18.

The use of a separate ferromagnetic element 36, when replaceable, allows easy and complete sensor replacement without changing output shaft 18 of mechanical impact wrench 10, therefore, reducing costs. Further, the preferable use of a magneto-elastic ring 37 increases the longevity of mechanical impact tool 10 because ring 37 can withstand much larger impacts over a longer duration. It should be noted, however, that the above-presented teachings of the invention relative to the sensor are not intended to be limiting to the invention's other teachings. In other words, the embodiments of the invention described hereafter do not rely on the above-described sensor for their achievements.

Turning to the operation of power tool 10, an important feature of the invention is that sensor 30 is used to measure a time varying force signal or, in other words, the impulse of the impacts. This determination of impulse is then used to calculate torque as opposed to measuring it directly. Directly measuring torque, as in the related art, leads to inaccurate indications because of the point in time aspect of the measurement, hence, requiring the use of correction factors, peak and/or low pass filtering of torque peak measurements, or inaccurate assumptions of constant torque output. In contrast, including a time parameter which can be integrated allows for a more accurate perspective of tool activity. Since impulse is directly related to torque, the torque values corresponding to the determined impulse values can be derived to obtain more accurate torque values.

Impulse I is generally defined as the product of force F and time t. As used in the present invention, impulse I is equationally represented as:

$$I = \int_{ti}^{tf} F\,dt$$

Where F is the force of the impact, dt is the differential of integration of time from $t_i$, the time of integration initiation, to $t_f$, the time of integration conclusion. Impulse, as used herein, is the integration of the product force and time over a desired time duration. It should be recognized that there are a variety of ways of setting $t_i$ and $t_f$. For instance, in the preferred embodiment, data is continuously streamed into a buffer in data processing unit or electronic control 50. When an impact is detected, $t_i$ is set to be impact minus some number (x) of clock counts, and $t_f$ is set to be impact plus some number (y) of clock counts. The parameters (x) and (y) are dependent on the tool used. As a result, a window of the force is created from $t_i$ to $t_f$ which can be integrated to derive an impulse value.

Torque is preferably derived from the determination of impulse as follows. Impulse I is also equivalent to change in linear momentum $\Delta\rho$, i.e., $I=\Delta\rho$. Linear momentum p can be converted to angular momentum L by taking the vector product of the impulse I and length of a torque arm r, i.e., $L=r\times\rho$. Torque T, while generally defined as force times length of torque arm r, can also be defined in terms of the time rate of change of angular momentum on a rigid body, i.e., $\Sigma T=dL/dt$. Accordingly, impulse I can be converted to torque T using the following derivation:

$$T=d(Ir)/dt$$

Therefore, the torque acting over the time duration t of the impact is $T=Ir/t$. Knowing the impulse I, the torque arm r, and the time duration t, an accurate measure of torque T can be derived from a determination of the impulse. The impulse value I can also be multiplied by a coefficient of proportionality C prior to determination of the torque T. The coefficient of proportionality C is a predetermined value based on the size of the particular tool, e.g., it may vary based on area of magnetic field and manufacturing tolerance.

Figure 2A:
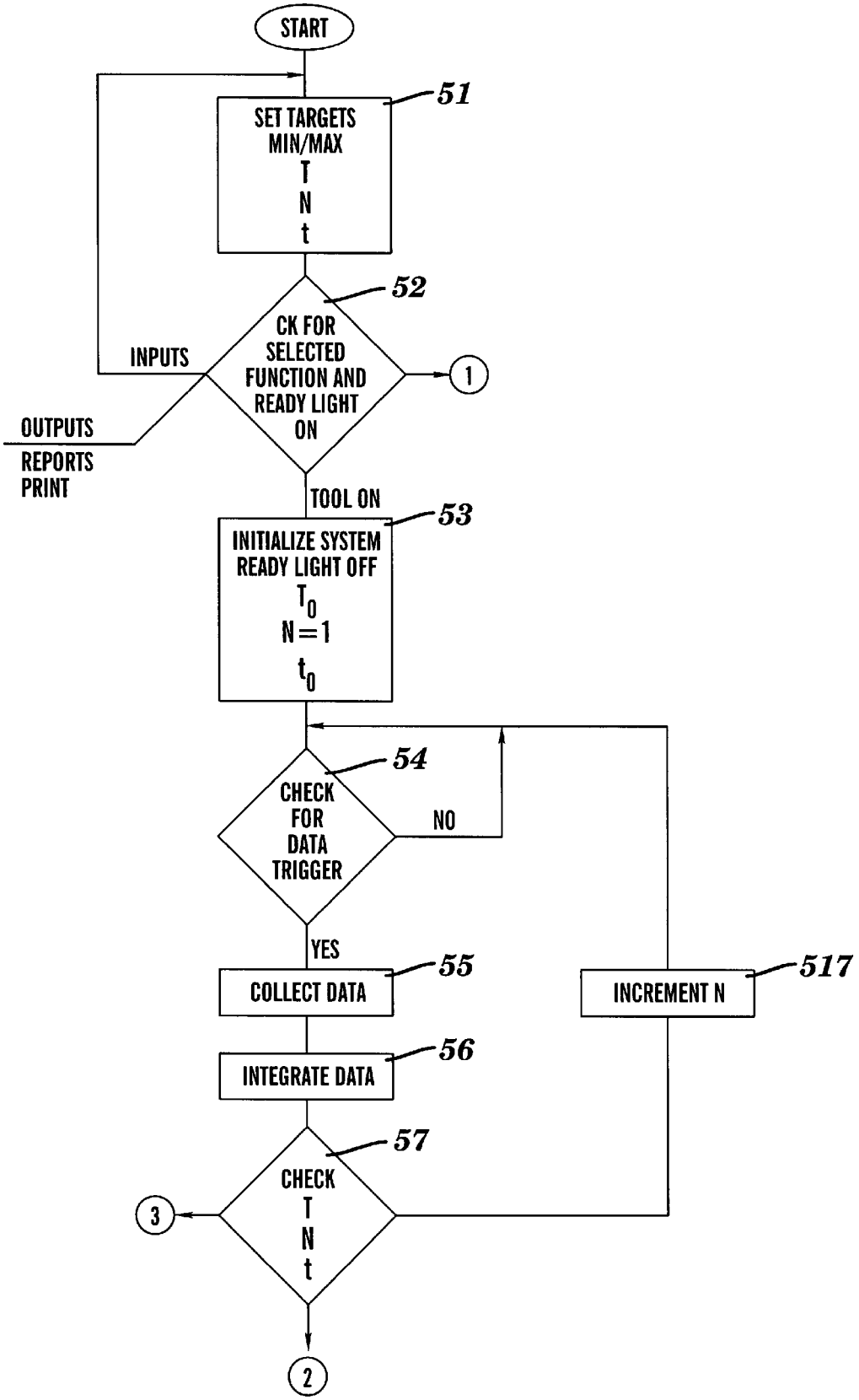
FIGS. 2A–2C show a flowchart of the processes in accordance with the present invention.
Figure 2B:
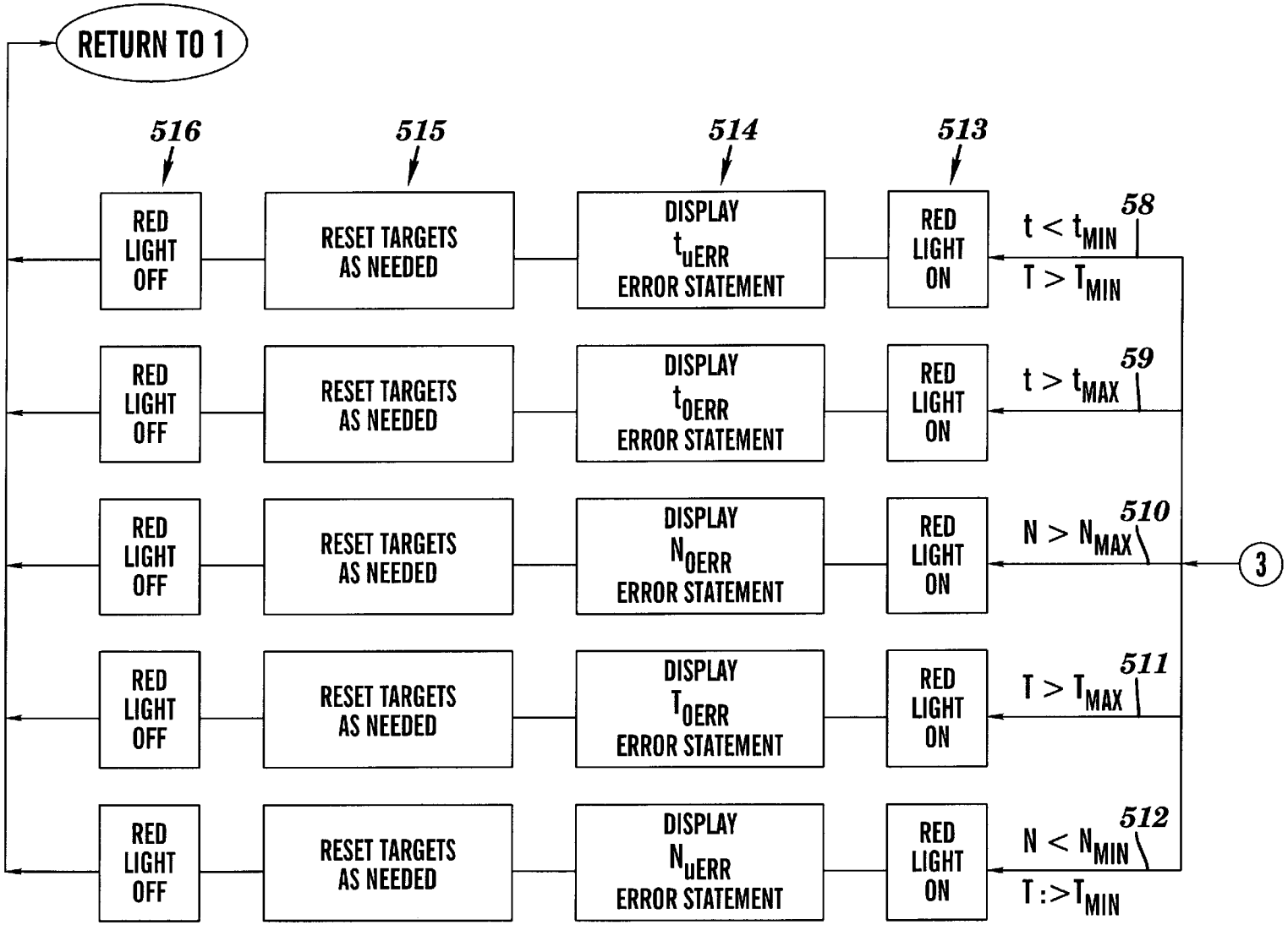
Figure 2C:
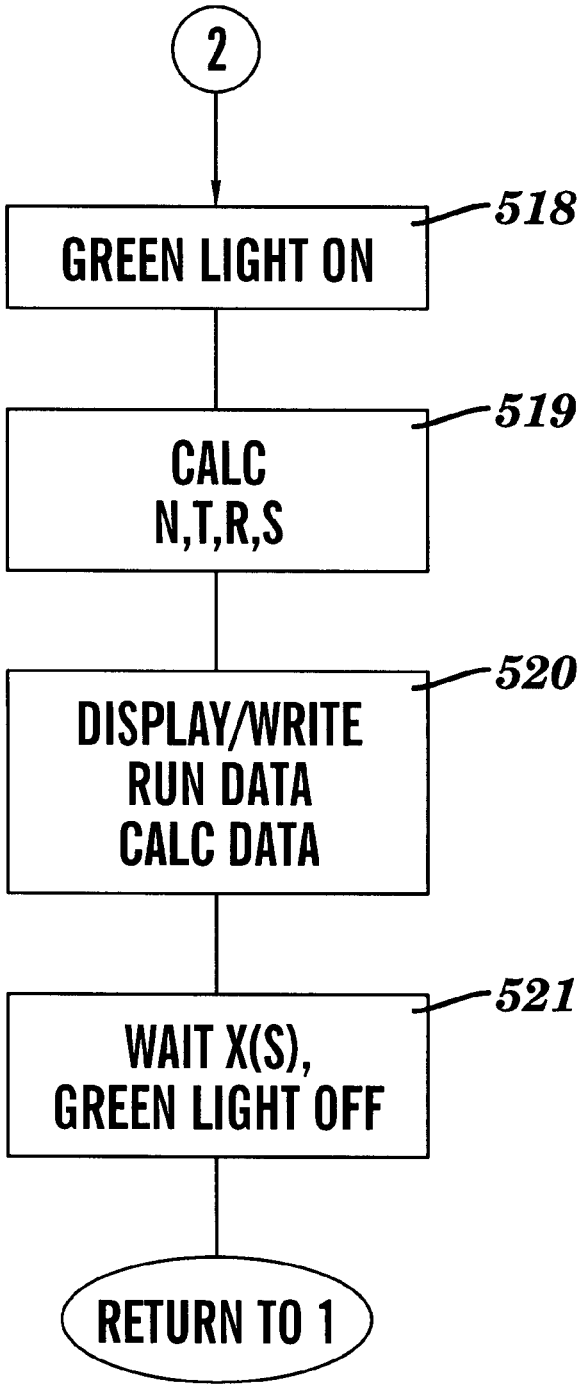

FIGS. 2A–2C show a flowchart diagram of process embodiments of the present invention. In step S1, the user of the power tool inputs selected parameter standards, or targets, for the given workpiece 40. "Standards" refers to individual target values, i.e., maximum allowable torque $T_{max}$, minimum number of impacts $N_{min}$, etc., or desired target value ranges, i.e., $T_{min}<T<T_{max}$, $N_{min}<N<N_{max}$, or $t_{min}<t<t_{max}$, etc. While in the preferred embodiment, torque T is the main parameter for tool control and two cross-checking parameters (i.e., impact number N and time duration t) are used, it should be recognized that other parameters can be measured and used for cross checking proper operation on a given workpiece.

Next, in step S2, the system is queried for: operational inputs, e.g., standards outlined above; outputs/reports to be generated and/or printed; data to be stored and/or reviewable; and whether the user is ready to use the tool. A ready light may be used to indicate the tool readiness for operation or to receive data. If the ready indication is not triggered, the process loops until a ready indication is given. When a ready indication is given, the process progresses to step S3 where the parameters to be measured are initialized, i.e., values of torque $T_o$, and impact time duration $t_o$ are set to 0, and the number of impacts N is set to 1.

At step S4, the in-operation process loop of power tool 10 begins. Monitoring of sensor 30 output is constant except when the standards are met or an error indication is created, as will be described below. The in-operation process loop begins when the monitoring of sensor 30 indicates operation of the tool by sensing an impact. Because an impact threshold occurs sometime after the start of an impact, a window of the data (which is collected in a buffer of electronic control 50) from the monitoring of sensor 30 that spans the impact threshold is used. As discussed above, when an impact is detected, $t_i$ is set to be impact minus some number of clock counts. Accordingly, when an initial impact is sensed, the system can go back (x) clock counts to determine where the in-operation processing should begin. If no operation is sensed, the process loops until operation is sensed.

When operation is activated, the process proceeds to step S5 where data collection is made. In the preferred embodiment, impulse I, number of impacts N, and time duration t are measured. Impulse I is created by integrating over time the force applied as described above. Torque T is then calculated or derived from impulse I according to the above described derivation at step S6.

Next, as shown in FIG. 2B, at steps S7–S12 the data collected is compared to inputted standards, or a combination thereof. Specifically, at step S9, a determination of whether $t>t_{max}$ is made; at step S10, a determination of whether $N>N_{max}$ is made; and at step S11, a determination of whether $T>T_{max}$ is made. Combinations of standard checking can be advantageous also. For example, at step S8, determinations of whether $t<t_{min}$ and $T>T_{min}$ are made; and at step S12, determinations of whether $N<N_{min}$ and $T>T_{min}$ are made. Other comparisons are also possible.

As indicated at step S13, when the standards are not met, a red error light is turned on. Simultaneously, electronic control 50 activates shutoff 15 and operation stops. At step S14, an appropriate error signal is created depending on which parameter is violated, e.g. , $T_{oerr}$, $N_{oerr}$, $T_{oerr}$, $T_{uerr}$, $t_{uerr}$, etc. The subscript "oerr" symbolizes that a maximum value, e.g., $T_{max}$, was exceeded, and the subscript "uerr" symbolizes that a minimum value, e.g., $N_{min}$, was not met. Error statements that do not indicate whether the error is based on high or low violation also could be used, e.g., $t_{err}$. At step S15, any necessary target resets are produced. At step S16, the red light is turned off and the process then returns to step S2 to begin operation again, if desired.

Preferably, control of power tool 10 is based on torque T, as derived from impulse I, alone. As mentioned above, however, the use of multiple standards and multiple standard checking allows for a cross-checking for proper operation on a given workpiece. A possible inappropriate outcome on, for example, a bolt and nut workpiece is where the bolt and nut are cross threaded. In this example, where torque measurements indicate a proper connection, number of impacts N may not meet standards, thus indicating the presence of cross threading.

If no error is indicated at steps S7–S12, operation of the tool loops back to step S4. During the loop, at step S17, the number of impacts N is incremented by one.

Through steps S7–S12, the system also determines when the standards are satisfactorily met. That is, when $T_{min}<T<T_{max}$; $N_{min}<N<N_{max}$; and $t_{min}<t<t_{max}$, etc., are satisfied. When this occurs, the process proceeds to step S18, as shown in FIG. 2C. At step S18, a green light is turned on indicating proper operation on the workpiece, and simultaneously tool operation is stopped by electronic control 50 activating shutoff 15.

At step S19, statistical analysis of the operation is conducted. For instance, the final number of impacts N, the average torque T applied, the range R of torque T applied, or standard deviation S can be calculated. It should be noted that other processing of data can occur and not depart from the scope of the invention. For example, statistical values such as: mean average, ranges, and standard deviations, etc., of all measured parameters can be calculated, if desired. Further, error indicators can also be created based on these statistical values, if desired.

At step S20, the data gathered and/or calculated is displayed and/or written to data storage, as desired.

At step S21, the process waits X(s) amount of time before turning off the green light and proceeding to step S2 for further operation as desired by the user. The process then returns to step S2 to begin operation again.

The above process of measuring impulse and deriving torque values therefrom provides a more accurate control of power tool 10.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

In particular, it should be noted that the teachings of the invention regarding the determination of torque using impulse measurements are applicable to any power impact tool and that the above description of the preferred embodiment in terms of a mechanical impact tool and, more particularly, to a mechanical impact wrench should not be considered as limiting the invention to such devices.

We claim:

1. A process for determining the torque applied by a power impact tool, comprising the steps of:

measuring a time-varying force signal for a tool impact; determining an impulse value of said tool impact; and calculating a torque value of the power impact tool from the impulse value.

2. The process of claim 1, wherein determining the impulse value includes integrating the force of the tool impact for a set time duration.

3. The process of claim 2, wherein calculating the torque value from the impulse value includes multiplying a preliminary torque value by a constant of proportionality.

4. A process for controlling a power tool that applies repetitive torque impacts to a workpiece, comprising the steps of:

calculating an impulse value from a measured force value of each tool impact;

calculating a torque value of the power tool from the impulse value;

determining whether the torque value meets a torque standard for the workpiece; and stopping operation of the power tool when the torque value violates the torque standard.

5. The process of claim 4, further including the steps of:

counting a number of tool impacts;

determining whether the number of tool impacts meet an impact number standard for the workpiece; and stopping operation of the tool when the number of tool impacts violates the impact number standard.

6. The process of claim 4, further including the steps of:

determining a time duration of the tool operation;

determining whether the time duration meets a time duration standard for the workpiece; and stopping operation of the tool when the time duration violates the time duration standard.

7. The process of claim 4, further including the step of providing a visual indication as to whether the standard has been violated.

8. A process for controlling a mechanical impact tool, comprising the steps of:

calculating an impulse value of each tool impact;

calculating a torque value of the tool from the impulse value;

determining whether the torque value meets a torque standard for a workpiece; and stopping operation of the tool when the torque value violates the torque standard.

9. The process of claim 8, further including the steps of:

counting a number of tool impacts;

determining whether the number of tool impacts meet an impact number standard for the workpiece; and stopping operation of the tool when the number of tool impacts violates the impact number standard.

10. The process of claim 8, further including the steps of:

determining a time duration of tool operation;

determining whether the time duration meets a time duration standard for the workpiece; and stopping operation of the tool when the time duration violates the time duration standard.

11. A mechanical impact wrench comprising:

a motor;

a mechanical impact transmission mechanism coupled to the motor to repetitively transmit an impact to an output shaft; and an electronic control to control operation of the mechanical impact wrench, said electronic control based on the measured impact force imparted by the mechanical impact transmission mechanism.

12. The mechanical impact wrench of claim 11, wherein the electronic control includes a sensor for measuring an impact force, and determines an impulse value of the tool impacts.

13. The mechanical impact wrench of claim 12, wherein the electronic control unit converts the impulse value to a torque value and uses the torque value to control the mechanical impact wrench.

14. The mechanical impact wrench of claim 11, wherein mechanical impact transmission mechanism includes a hammer and anvil which strike one another to impart an impact to a workpiece.

* * * * *